United States Patent [19]

Handa

[11] Patent Number: 4,632,662

[45] Date of Patent: Dec. 30, 1986

[54] MOUNTING STRUCTURE FOR AN ELECTRONIC PARTS UNIT OF AN OUTBOARD ENGINE

[75] Inventor: Kenichi Handa, Hamamatsu, Japan

[73] Assignee: Sanshin Kogyo Kabushiki Kaisha, Shizuoka, Japan

[21] Appl. No.: 598,382

[22] Filed: Apr. 9, 1984

[30] Foreign Application Priority Data

Apr. 12, 1983 [JP] Japan ..... 58-62996

[51] Int. Cl.[4] ..... B63H 21/30

[52] U.S. Cl. ..... 440/52; 440/77; 361/383

[58] Field of Search ..... 440/52, 77, 88; 361/394, 339, 403; 248/560; 267/140.5

[56] References Cited

U.S. PATENT DOCUMENTS

| | | | |
|---|---|---|---|
| 3,610,198 | 10/1971 | Alexandrowicz | 440/77 |
| 3,813,582 | 5/1974 | Gikow | 361/399 |
| 4,050,093 | 9/1977 | Crall et al. | 361/399 |

*Primary Examiner*—Trygve M. Blix
*Assistant Examiner*—Jesûs D. Sotelo
*Attorney, Agent, or Firm*—Ernest A. Beutler

[57] ABSTRACT

An outboard motor including an improved mounting arrangement for electronic components wherein they are mounted so that induction air will pass across and cool them. In addition, the electronic components are mounted on a circuit board and the mounting of the circuit board relative to the engine is in such a direction that the vibrations generated by the outboard motor are less likely to damage the electronic module.

10 Claims, 4 Drawing Figures

MOUNTING STRUCTURE FOR AN ELECTRONIC PARTS UNIT OF AN OUTBOARD ENGINE

BACKGROUND OF THE INVENTION

This invention relates to a mounting structure for an electronic parts unit of an outboard motor and more particularly to an improved mounting structure for an electronic parts unit that precludes the likelihood of damage.

In outboard motors, there is an increasing use of electronic units for controlling the operation of various components of an outboard motor. Such components may include microcomputers or the like which are mounted on a substrate such as a printed circuit board and which are potted in a suitable potting compound such as a resin. Although the potting compound is employed for protecting the circuit board and components from damage, the nature of the potting is such that air gaps may be formed around the various components. Due to the compact nature of an outboard motor, the electronic unit is mounted normally in such a manner that it experiences the vibrations of the outboard motor during its operation. The presence of air gaps in the potting compound and these vibrations can frequently cause damage to the printed circuit board or substrate or the connection between circuit and the discrete components.

It is, therefore, a principal object of this invention to provide an improved mounting arrangement for the electronic unit of an outboard motor.

It is a further object of this invention to provide a mounting arrangement for the electronic unit of an outboard motor that minimizes the likelihood of damage.

In addition to the danger of damage to the electronic components from vibration, the compact nature of the outboard motor and the mounting of the electronic unit in proximity to the internal combustion engine gives rise to a further difficulty. The outboard motor and particularly its internal combustion engine is normally mounted within a protective cowling so as to protect the components from water, and particularly salt water when the motor is operated in a marine environment. However, the protective cowling tends to confine the heat generated by the internal combustion engine and this heat can very well damage the electronic components, many of which are extremely heat sensitive.

It is, therefore, a still further object of this invention to provide an improved mounting arrangement for the electronic unit of an outboard motor that affords cooling of the electronic unit.

SUMMARY OF THE INVENTION

A first feature of this invention is adapted to be embodied in a mounting arrangement for electronic components of an outboard motor or the like. The electronic component consists of an electronic module having a substrate carrying a circuit and at least one electronic component mounted on the substrate. The electronic module is stronger in one direction than in another direction. The outboard motor vibrates during its operation and the vibrations are strongest in a first direction. In accordance with this feature of the invention, the electronic module is mounted so that the one direction is aligned with the first direction of vibration of the outboard motor.

Another feature of the invention is also adapted to be embodied in a mounting arrangement for the electronic components of an outboard motor or the like. In accordance with this feature of the invention, an internal combustion engine is provided that is contained within a protective cowling. An electronic component is mounted within the cowling and the cowling has an air inlet communicating with the atmosphere and the interior of the cowling for delivery of induction air to the internal combustion engine. In accordance with this feature of the invention, the electronic component is positioned so as to be interposed in the path of air flow from the air inlet to the engine induction system for cooling the electronic component.

DETAILED DESCRIPTION OF THE PREFERRED EMBODIMENTS

Figure 1:
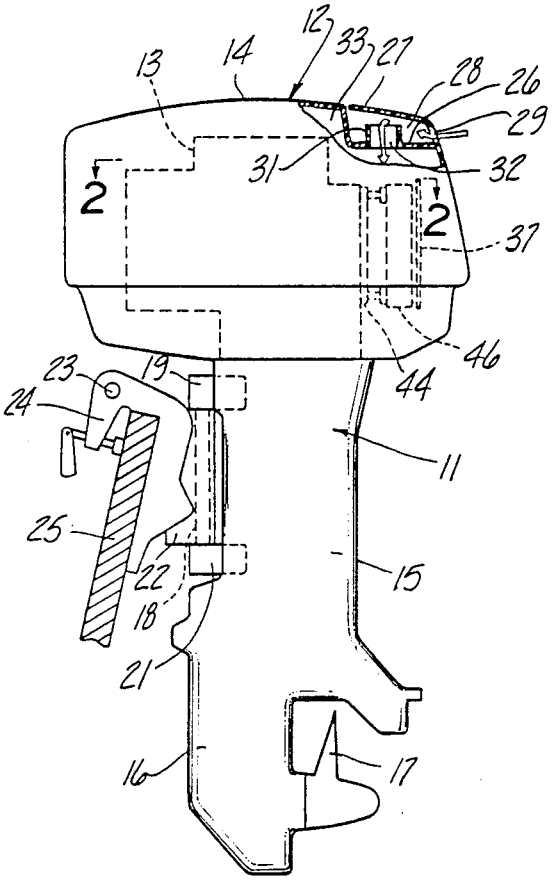
FIG. 1 is a side elevational view of an outboard motor constructed in accordance with an embodiment of this invention attached to the transom of a boat, with portions broken away.

Referring first to FIG. 1, an outboard motor constructed in accordance with an embodiment of the invention is identified generally by the reference numeral 11. The outboard motor 11 includes a power head, indicated generally by the reference numeral 12, and which includes an internal combustion engine 13 that is enclosed within a protective cowling 14. In the illustrated embodiment, the engine 13 is of the V type although it is to be understood that the invention may be utilized in conjunction with engines of other types and other engines than reciprocating engines.

The engine 13 has its crankshaft vertically disposed and drives a drive shaft (not shown) that extends through a drive shaft housing 15 into a lower unit 16. Contained within the lower unit 16 is a suitable forward, neutral, reverse transmission through which the drive shaft drives a propeller 17.

A steering shaft 18 is connected to the drive shaft housing 15 by means including upper and lower vibration absorbing assemblies 19 and 21. The steering shaft 18 is, in turn, journaled for rotation about a vertically extending axis by means of a swivel bracket 22. The swivel bracket 22 is, in turn, supported for pivotal movement about a horizontally extending pivot axis by means of a pivot pin 23. The pivot pin 23 is rotatably journaled in a clamping bracket 24 which is affixed in a suitable manner to a transom 25 of an associated watercraft.

As has been previously noted, the outer cowling 14 is provided for encircling and protecting the internal combustion engine 13. However, it is necessary to provide a source of intake air for the induction system of the engine 13. For this purpose, the rear portion of the outer cowling 14 is provided with a depressed portion 26 to which a cover plate 27 is affixed so as to form an air inlet cavity 28. A rearwardly opening air inlet 29 is formed between the cover plate 27 and the recessed portion 26 so as to admit atmospheric air to the air inlet cavity 28. In turn, the wall 26 has an upstanding cylindrical portion 31 that defines an air inlet opening 32 that communicates the cavity 28 with an air space 33 that surrounds the engine 13. In this manner, inlet air may be drawn through the air inlet opening 29 and pass through the air inlet opening 32 to the cowling interior 33 for induction into the engine 13. This tortuous path insures against the introducton of water into the interior 33 of the cowling 14.

Figure 2:
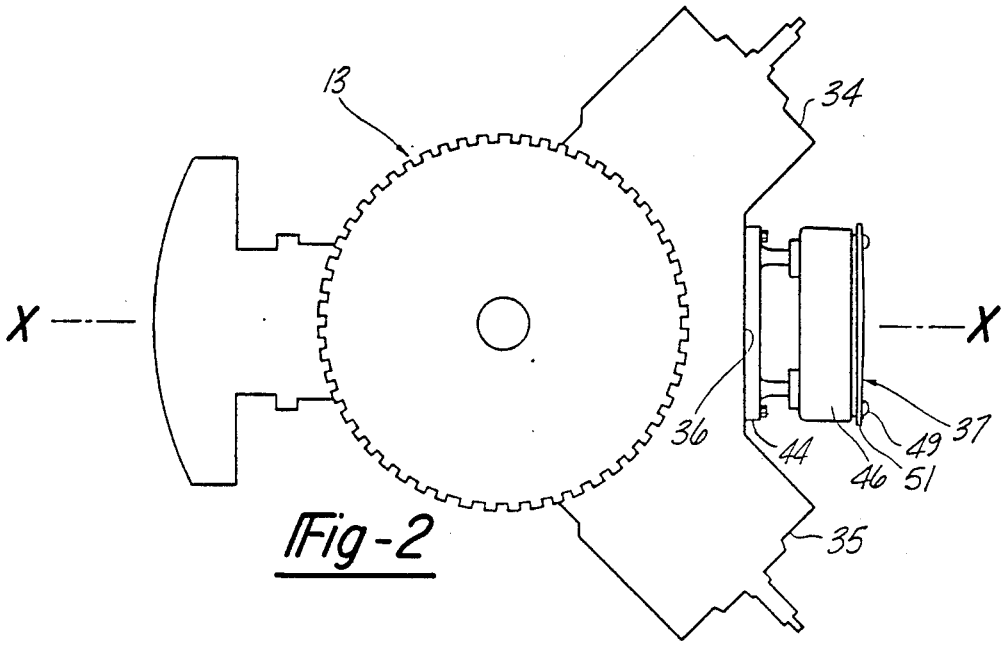
FIG. 2 is a top plan view on an enlarged scale, looking generally in the direction of the line 2—2 of FIG. 1.

Referring now additionally to FIG. 2, the engine 13, as has been noted, is of the V type and has cylinder banks 34 and 35 that define a generally planar area 36 in the valley of the V between the banks 34 and 35. The planar area 36 lies substantially immediately beneath the air inlet opening 32 of the outer housing wall 26 as may be clearly seen in FIG. 1.

The engine and other components of the outboard motor create vibrations and the largest magnitude of these vibrations extend in a generally longitudinally extending plane as indicated by the line X—X in FIG. 2. The mountings 18 and 19 have resilience in this direction so as to afford some vibration damping between the hull 25 and the outboard motor 11.

The outboard motor 11 is also provided with an electronic module, indicated generally by the reference numeral 37. The module 37 includes a number of electronic components 38, 39 and so on which are mounted on a substrate consisting of a printed circuit board 41 that contains a suitable electronic circuit or circuits. The components 38, 39 and so on may be of any known type such as microprocessors or other components for controlling the operation of the engine 13 or other accessories. The printed circuit board 41 is supported within an outer housing or case 42 and the components 38 and 39 and board 41 are potted within a suitable potting composition 43 which may be formed from an epoxy resin or the like.

The resin 43 is foamed in place and, therefore, it is possible for air gaps or bubbles to form when the resin sets. If these bubbles are formed around any of the components 38 or 39, as may be readily likely, vibrations of the unit 37 will put stresses on the substrate 41 which might cause it and its associated printed circuit to fracture and thus cause electrical malfunctions. In addition, the vibrations may tend to cause the connection between the components 38 and 39 and the substrate or board 41 to become broken or weakened which also can cause circuit problems or malfunctions. It should be noted that the board or substrate 41 and its connection to the components 38 and 39 is considerably stronger in a plane perpendicular to the substrate 41 than in the plane of the substrate 41. In accordance with the invention, therefore, the module 37 is mounted so that the substrate or board 41 is disposed at a right angle to the principal vibration axis X—X so that vibrations of the outboard motor 11 are less likely to damage the substrate 41, the components of the electronic module 37 and the connections.

The mounting arrangement for the unit 37 includes a mounting base 44 that is affixed in a suitable manner to the engine in the planar area 36. A generally cup shape mounting base 46 has a number of openings formed in its lower wall that receive elastomeric dampers 47 which, in turn, pass bolts 48 that are tapped into bosses 49 formed on the mounting plate 44 so as to resiliently support the mounting base 46 to the mounting plate 44. Mounting screws 50 affix a cover plate 51 to the module case 42 and, in turn, to bosses formed in the mounting base 46 so as to secure the module 37 together and so as to insure water tightness. If desired, a suitable gasket (not shown) may be interposed between the cover 51 and the case 42.

It should be noted that the mounting of the module 37 not only mounts it so that it is oriented with its strongest direction aligned with the direction of maximum vibration X—X but further in proximity to the air inlet opening 32 so that induction air drawn from the outside for the engine 13 will almost immediately and first pass over the module 37 so as to cool it and protect it from the heat generated by engine operation.

Figure 3:
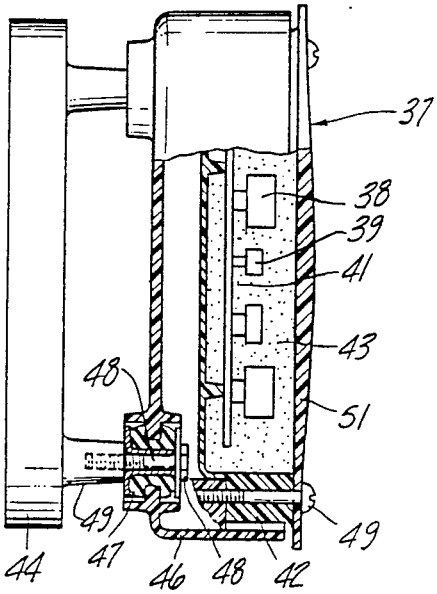
FIG. 3 is a still further enlarged top plan view, with a portion broken away, showing the mounting of the electronic module.
Figure 4:
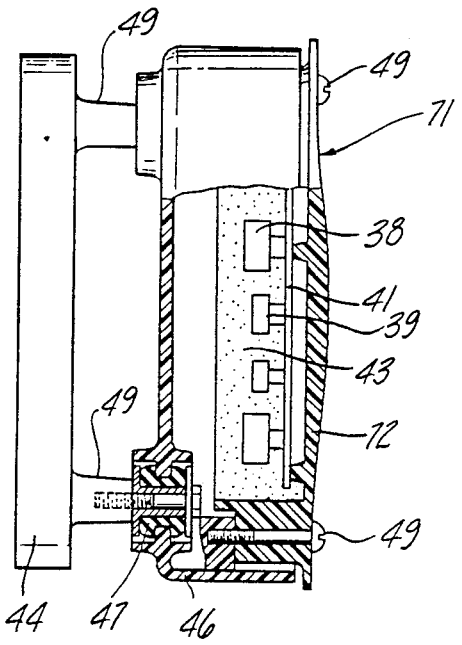
FIG. 4 is an enlarged view showing another embodiment of the invention, with a portion broken away.

FIG. 4 shows another embodiment of the invention wherein an electronic module, indicated generally by the reference numeral 71, is provided. This embodiment is substantially the same as the embodiment of FIG. 3. However, in connection with this embodiment, the containing box 72 of the circuit board or substrate 41 and the associated components 38, 39 and potting compound 43 are oriented so that mounting of the base 72 in the mounting bracket 46 will cause the base 72 to act, itself, as the cover plate. Thus, the cover plate of the previously described embodiment is unnecessary with this embodiment.

Again, the unit 71 is mounted so that its strongest direction is aligned with the axis X—X of principal vibration of the outboard motor 11 so as to minimize the likelihood of vibration damage. Also, the unit 71 is also mounted immediately below the air inlet opening 32 so as to be cooled by the ambient air and protected from the heat generated by the operation of the engine.

It should be readily apparent that the described embodiments provide a construction wherein the electronic module is protected since it is mounted so that its strongest point is aligned with the axis of maximum vibration and also so that it is aligned with the air inlet opening so as to be cooled by the induction system air drawn to the internal combustion engine immediately from the atmosphere. Although two embodiments of the invention have been illustrated and described, various changes and modifications may be made without departing from the spirit and scope of the invention, as defined by the appended claims.

I claim:

1. In a mounting arrangement for the electronic components of an engine comprising an electronic module consisting of a substrate carrying a circuit and at least one electronic component mounted on said substrate, said electronic module being stronger in one direction than in another direction, said internal combustion engine generating vibrations during its operation, said vibrations being strongest in a first direction, the improvement comprising means mounting said module directly upon said internal combustion engine so that its one direction is aligned with said first direction.

2. In a mounting arrangement as set forth in claim 1 wherein the substrate comprises a printed circuit board and the substrate and electronic components are potted in a potting compound.

3. In a mounting arrangement as set forth in claim 2 wherein there are a plurality of electronic components mounted on the substrate with the mounting of said components upon said substrate all being aligned in the same direction.

4. In a mounting arrangement as set forth in claim 1 wherein the mounting means further includes means for resiliently mounting the electronic module in the one direction.

5. In a mounting arrangement as set forth in claim 1 wherein the engine comprises a main component defining a cylinder block and the module is mounted directly on said main component.

6. In a mounting arrangement for the electronic components of an internal combustion engine comprising an electronic module consisting of a substrate carrying a circuit and at least one electronic component mounted on said substrate, said electronic module being stronger in one direction than in another direction, said internal combustion engine generating vibrations during its operation, said vibrations being strongest in a first direction, the improvement comprising means mounting said module so that its one direction is aligned with said first direction and for providing resilience in said first direction, said mounting means comprising a generally cup shaped member having elastomeric bushings affixed therein, said electronic module being mounted within said cup shaped member and further including a closure plate extending across the mouth of said cup shaped member.

7. In a mounting arrangement as set forth in claim 6 wherein the internal combustion engine is a portion of an outboard motor having a protective cowling encircling said internal combustion engine, said protective cowling being formed with an air inlet opening for admitting ambient air into the interior of said cowling for induction into the engine, said electronic module being positioned adjacent said air inlet opening and in the path of air flow therethrough.

8. In a mounting arrangement for the electronic components of an internal combustion engine comprising an electronic module consisting of a substrate carrying a circuit and at least one electronic component mounted on said substrate, said electronic module being stronger in one direction than in another direction, said internal combustion engine generating vibrations during its operation, said vibrations being strongest in a first direction, the improvement comprising means mounting said module so that its one direction is aligned with said first direction and for providing resilience in said first direction, said means for mounting the module comprises a generally cup shaped member having resilient bushings affixed therein for attachment to its supporting component, the electronic module comprising a printed circuit board contained within a generally planar member and including a potting compound surrounding said printed circuit board and said electronic component, said electronic module being mounted within said cup shaped member so that said planar member forms a closure for said cup shaped member.

9. In a mounting arrangement as set forth in claim 8 wherein the internal combustion engine forms a component of an outboard motor having a protective cowling encircling said internal combustion engine, said protective cowling being formed with an air inlet opening for admitting ambient air into the interior of said cowling for induction into the engine, said electronic module being positioned adjacent said air inlet opening and in the path of air flow therethrough.

10. A mounting arrangement for an electronic component of an outboard motor comprising an internal combustion engine having a main component defining a cylinder block, an outer cowling surrounding said internal combustion engine, an induction system air inlet formed in said outer cowling, the improvement comprising said electronic component being mounted in proximity to said air inlet within said outer cowling upon said main component for passage of induction air across said electronic component.

* * * * *